United States Patent [19]

Hata et al.

[11] Patent Number: 4,933,255

[45] Date of Patent: Jun. 12, 1990

[54] METHOD OF FABRICATING AN ELECTROPHOTOGRAPHIC PHOTOSENSOR

[75] Inventors: Yasuhiko Hata; Hiroyuki Mizukami, both of Hiratsuka; Toshio Itoh, Yamanishi, all of Japan

[73] Assignee: Kabushiki Kaisha Komatsu Siesakusho, Tokyo, Japan

[21] Appl. No.: 348,184

[22] Filed: May 8, 1989

Related U.S. Application Data

[63] Continuation of Ser. No. 154,475, Feb. 9, 1988, abandoned, and Ser. No. 872,925, Jun. 11, 1986, abandoned.

[51] Int. Cl.[5] ..... G03G 5/14; G03G 5/082

[52] U.S. Cl. ..... 430/131; 430/60; 430/65

[58] Field of Search ..... 430/60, 65, 131

[56] References Cited

U.S. PATENT DOCUMENTS

| | | | |
|---|---|---|---|
| 3,615,405 | 10/1971 | Shebanow | 430/65 X |
| 4,403,026 | 9/1983 | Shimita et al. | 430/65 |
| 4,416,962 | 11/1983 | Shirai et al. | 430/65 |

FOREIGN PATENT DOCUMENTS

| | | | |
|---|---|---|---|
| 2430115 | 1/1975 | Fed. Rep. of Germany | 430/65 |
| 58-5749 | 1/1983 | Japan | 430/65 |
| 59-157652 | 9/1984 | Japan | 430/65 |
| 1446111 | 8/1976 | United Kingdom . | |

*Primary Examiner*—Roland E. Martin
*Attorney, Agent, or Firm*—Diller, Ramik & Wight

[57] ABSTRACT

In an electro-photographic photosensor wherein amorphous silicon as a photoconductive layer is formed on the surface of an aluminum base which has been processed to be alumite layer consisting of a porous layer and barrier layer, amorphous silicon is formed directly on the surface of the porous layer in which porosities is remained by the elimination of the process of sealing porosities. Further, when aluminum is processed by electrolyzation to be alumite, thickness of the barrier layer and the porous layer are appropriately set to provide good adhesive strength of amorphous silicon to the aluminum base and good electrostatic characteristics by adjusting respectively a voltage and duration of the electrolyzation.

2 Claims, 3 Drawing Sheets

METHOD OF FABRICATING AN ELECTROPHOTOGRAPHIC PHOTOSENSOR

This application is a continuation of application Ser. No. 07/154,475 and 06/872,925, filed 02/09/88 and 06/11/86, respectively, and both now abandoned.

BACKGROUND OF THE INVENTION

1. Field of the Invention

The present invention relates to a method of fabricating an electro-photographic photosensor such as a photosensitive drum of a copy machine.

2. Description of the Prior Art

An electro-photographic photosensor in which a photoconductive layer made of amorphous silicon (a-Si:H) is formed on a base made of aluminum has been widely used. The photosensor which uses as its base aluminum has the advantage of providing good electrostatic characteristics. However, such photosensor has the disadvantage that the long time employment may cause the amorphous silicon layer constituting the photoconductive layer to peel off because such amorphous silicon has inherently weakness in adherence to aluminum.

Therefore, in prior art, for example, in U.S. Pat. No. 4,416,962 "ELECTRO-PHOTOGRAPHIC MEMBER HAVING ALUMINUM OXIDE LAYER" Shirai et al., amorphous silicon used as the photoconductive layer is formed by an evaporated process on a surface of an alumite layer in which very small porosities formed in an oxidizing process have been processed to seal. As a result of that, the adhesive strength of the amorphous silicon to the aluminum base is enhanced.

FIGS. 1(*a*) and 1(*b*) show the surface of the aluminum base processed to the alumite and further to seal its porosities. More particularly, in the alumite process, by the process of electrolyzation using as an positive electrode an aluminum base 10 and as electrolyte sulfuric acid or oxalic acid, an alumite layer having a double structure of a porous portion (porous layer) 21 dissolved by the electrolyte and a remaining insoluble fine portion (barrier layer) 21 is formed as an oxide film of the positive electrode, as shown in FIG. 1(*a*). Further, after the above mentioned process, by processing said alumite layer to seal its porosities with high pressured vapor or boiled water, the porous layer of the alumite layer is chemically compounded with water, with the whole volume being swollen, and subsequently becomes a stable oxide film 23 sealed its porosities, as shown in FIG. 1 (*b*).

In the alumite layer formed by the alumite process, a thickness of the porous layer 21 made of amorphous $Al_2O_3$ is in proportion to a duration of electrolyzation, while a thickness of the barrier layer 22 made of crystalline $Al_2O_3$ is in proportion to electrolyzation voltage.

Usually, the diameter of each of the porosities in the porous layer 21 is about 100 Å to 300 Å, and the density of the those porosities is about hundreds million to a thousand and several hundreds million per 1 $mm^2$. Both of the diameter and the density are dependent on the condition of the electrolyzation.

In the case of an amorphous silicon photosensor which uses as its base aluminum, the adhesive strength of the amorphous silicon film to the aluminum base can be enhanced by forming a photoconductive film made of an amorphous silicon on the alumite film which has been previously formed on the aluminum base by the above mentioned process of sealing porosities. Such process enhances the adhesive strength to a certain extent, but cannot completely prevent the amorphous silicon film from peeling off.

Further, although the alumite process to the surface of the aluminum base enhances the adhesive strength as above mentioned, electrostatic characteristics of the electro-photographic photosensor is degraded by the process.

SUMMARY OF THE INVENTION

In accordance with the present invention, to enhance adhesive strength of an amorphous silicon film to an aluminum base, when an amorphous silicon as a photoconductive layer is formed on the surface of an aluminum base which has been processed to be alumite, the process of sealing porosities in the surface of the alumite film to stabilize it is eliminated, and the surface of the alumite film is remained porous, that is, extremely activated and wide in a surface area. Consequently, the adhesive strength of the amorphous silicon to the aluminum base is significantly improved, and such defects as peeling the amorphous silicon off can be completely prevented.

Further, in accordance with the present invention, to make the photosensor more preferable, a thickness of a porous layer and a barrier layer constituting the alumite film is adjusted to an appropriate thickness to provide not only the strong adhesiveness but also excellent electrostatic characteristics. This is based on the result of experiments which indicates that the thinner the barrier layer is, the more electrostatic characteristics are improved, and that the thicker the porous layer is within allowance of electrostatic characteristics, the more an adhesive strength is improved. To show in concrete, assuming that the thickness of the barrier layer is $\alpha$ and the thickness of the porous layer is $\beta$, and $\alpha$ and $\beta$ are set within the following range respectively;

ti $10\ \text{Å} \leqq \alpha \leqq 500\ \text{Å}$ $$0\ \mu m < \beta \leqq 5\ \mu m$$

both of electrostatic characteristics and adhesive strength indicate excellence. Further, as mentioned above, thickness of the barrier layer can be adjusted by electrolyzation voltage, while thickness of the porous layer can be adjusted by the duration of the electrolyzation.

Thus, in accordance with a method of fabricating an electro-photographic photosensor of the present invention, the adhesive strength of an amorphous silicon to an aluminum base can be significantly improved without causing such defects as that the amorphous silicon layer peels off.

Further, by setting thickness of the barrier layer and the porous layer on said aluminum base by an alumite process the optimum value within the above mentioned range, not only adhesive strength but also electrostatic characteristics of the photosensor that is likely to be degraded by the alumite process can be provided with exellence.

DESCRIPTION OF THE PREFERRED EMBODIMENT

Figure 1A:
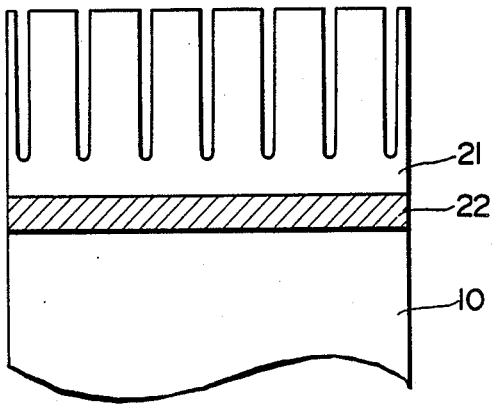
FIG. 1(a) PRIOR ART
FIGS. 1(*a*) and (*b*) are enlarged cross-sectional views of a part of an aluminum base for explaining each phase of process in accordance with a prior art.
Figure 1B:
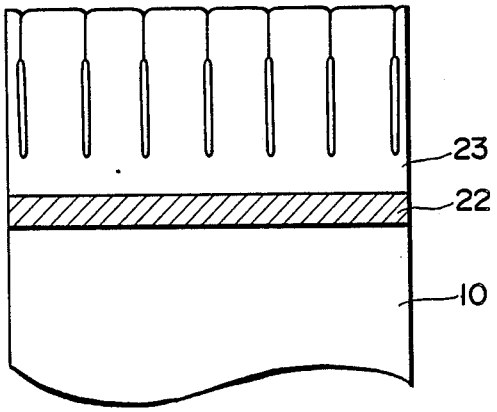
FIG. 1(b) PRIOR ART
Figure 2:
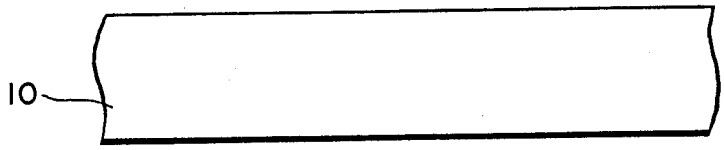
FIGS. 2(*a*) to (*d*) are enlarged cross-sectional views of an electro-photographic photosensor for explaining each step of a method of fabricating a photosensor in accordance with an embodiment of the present invention.
Figure 2:
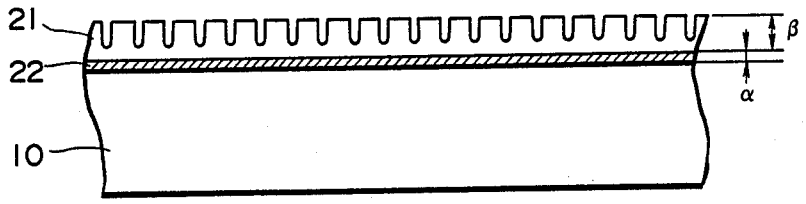
Figure 2:
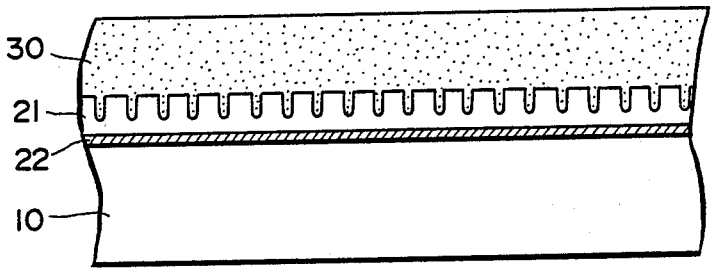
Figure 2:
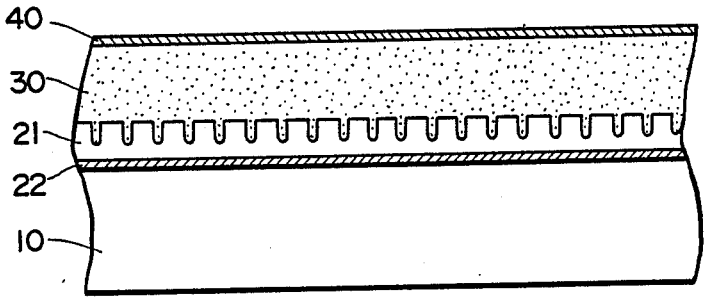

Referring to FIG. 2, a method of fabricating the electro-photographic photosensor in accordance with an embodiment of the present invention is described.

(1) At first, an alumite layer which comprises a porous layer 21 and a barrier layer 22, as shown in FIG. 2(*b*), is formed on the surface of an aluminum base 10, which is processed to be an appropriate shape such as a cylinder as a base of the photosensor (refer to FIG. 2(*a*)), by an electrolytic process using as a positive electrode the aluminum base 10 and as an electrolyte sulfuric acid or oxalic acid. In this electrolytic process, the electrolytic duration and the electrolytic voltage are adjusted to an appropriate value respectively, in order that the thickness $\beta$ of the porous layer 21 is set within the following range;

$$0\ \mu m < \beta \leqq 5\ \mu m$$

and the thickness $\alpha$ of the barrier 22 is set within the following range;

$$10\ Å \leqq \alpha \leqq 500\ Å$$

For example, it is assumed that the thickness $\beta$ of the porous layer 21 is set about 3 $\mu$m, and the thickness $\alpha$ of the barrier layer 22 is set about 10 Å. As mentioned before, there are actually hundreds million to a thousand million extremely small porosities per 1 $mm^2$ with diameter of about 100 Å to 300 Å in the porous layer 21 as shown in FIG. 2(*b*).

(2) After an alumite layer is thus formed, an amorphous silicon as the photoconductive layer 30 is formed with its thickness of about 30 $\mu$m, for example, directly on the surface of the porous layer 21 without any process of sealing porosities (refer to FIG. 2(*c*)). Thus, formation can be done by a known evaporated process, glow discharge process, or sputtering process.

(3) After an amorphous silicon as the photoconductive layer 30 is thus formed, finally, a fabrication of the photosensor is completed by forming as its surface protection layer 40, for example, a-SiC, a-SiN or a-SiO on the surface of the photoconductive layer 30 (refer to FIG. 2(*d*)). This formation can be done by the above mentioned process.

According to an endurance test and an electrostatic characteristic test using thus fabricated photosensor, the mechanical strength (especially, the adhesive strength of the photoconductive layer 30 to the aluminum base 10) and the electrostatic characteristics of the photosensor which comprises the photoconductive layer 30 and the aluminum base 10 have satisfied the requirement of the practical use.

Now, the result of the experiment which is concerned with the relationship between adhesive strength of the photoconductive layer 30 made of an amorphous silicon to the aluminum base 10 and thickness of the porous layer 21 and the barrier layer 22 in the alumite layer, and the relationship between the electrostatic characteristics of the photosensor and the above mentioned thickness are described.

Figure 3:
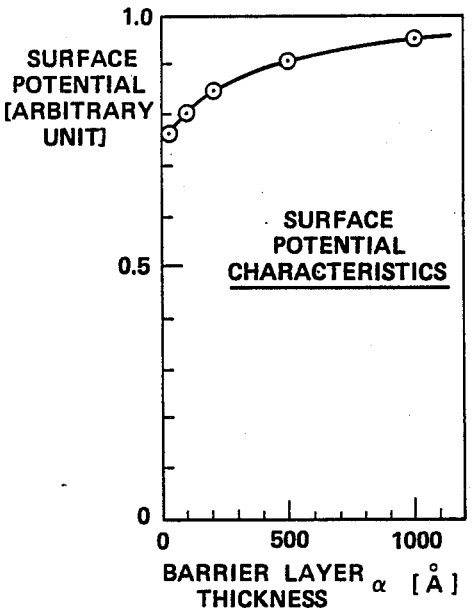
FIG. 3 is a graph showing the relation between thickness of a barrier layer and surface potential of a photosensor.

FIG. 3 showing the relationship between the thickness $\alpha$ of the barrier layer 22 and a surface voltage of the photosensor, indicates that the surface potential does not greatly decrease where the thickness $\alpha$ of the barrier layer is thin. In other words, the insulation is maintained even if the thickness $\alpha$ is thin.

Figure 4:
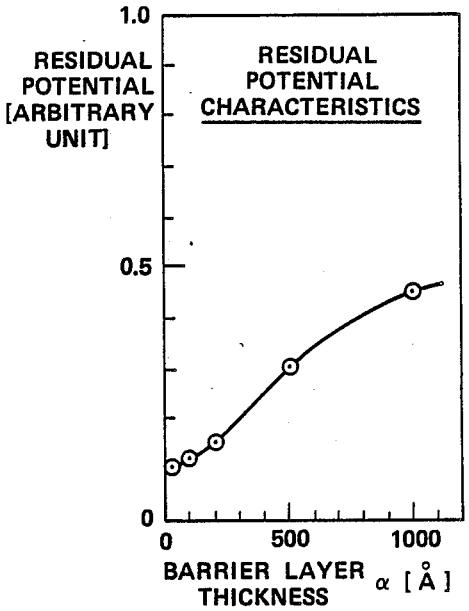
FIG. 4 is a graph showing the relation between thickness of a barrier layer and residual potential of a photosensor.

FIG. 4 showing the relationship between the thickness $\alpha$ of the barrier layer 22 and a residual potential of the photosensor, indicates that the thinner the thickness $\alpha$ of the barrier layer is, the more the residual potential decreases, that is, the more preferable as a photosensor.

Figure 5:
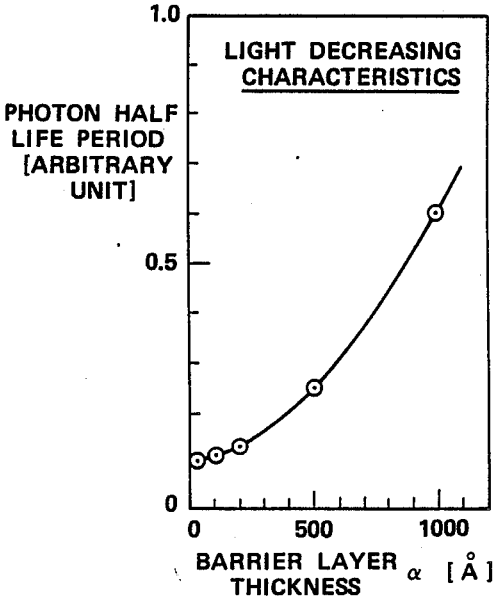
FIG. 5 is a graph showing the relation between the thickness of a barrier layer and a half life of a photon in the photosensor.

FIG. 5 showing the relationship between the thickness $\alpha$ of the barrier layer 22 and a half life period of a photon in the photosensor, indicates that the smaller the thickness $\alpha$ of the barrier layer is, the shorter a half life period of the photon is, that is, the higher the photo sensitivity is.

In conclusion, the thinner the thickness $\alpha$ of the barrier layer is, the more the electrostatic characteristics of the photosensor is improved.

On the other hand, it is confirmed that the adhesive strength of the photoconductive layer 30 to the aluminum base 10 depends upon the thickness $\beta$ of the porous layer 21, and that the greater the thickness $\beta$ is, the more the adhesive strength is strengthened.

The relative merits of the adhesive strength and the electrostatic characteristics in each combination of the thickness of the porous layer 21 and the barrier layer 22 are shown in the following table, where "0" represents "superior", "X" represents "inferior" and "Δ" represents "not superior, but no problem for practical uses".

| Porous layer | Barrier layer $\alpha$ 'Å' | | | | | |
|---|---|---|---|---|---|---|
| $\beta$ 'μm' | 10 | 100 | 200 | 500 | 1000 | |
| 0 | x | x | x | x | x | Adhesive strength |
| | o | o | o | Δ | x | Electrostatic characteristics |
| 3 | o | o | o | o | o | Adhesive strength |
| | o | o | o | Δ | x | Electrostatic characteristics |
| 5 | o | o | o | o | o | Adhesive strength |
| | Δ | Δ | Δ | x | x | Electrostatic characteristics |
| 7 | o | o | o | o | o | Adhesive strength |
| | x | x | x | x | x | Electrostatic characteristics |

This table indicates that the thicker the porous layer 21 is, the more the adhesive strength is improved. However, considering the electrostatic characteristics, it is preferable to set the thickness of the porous layer up to about 5 $\mu$m. Although it is preferable to make the barrier layer 22 thin as above mentioned, if the thickness of the barrier layer is between 10 Å and 500 Å, there is no problem in its electrostatic characteristics.

What is claimed is:

1. A method of fabricating an electro-photographic photosensor in which amorphous silicon as a photoconductive layer is formed on a surface of an aluminum base comprising the steps of:

forming an alumite layer which comprises a barrier layer having a thickness $\alpha$ and a porous layer having a thickness $\beta$ on the surface of said aluminum base by an alumite process such that the thickness $\alpha$ and $\beta$ fall within the respective ranges of:

$10\ \text{Å} \leqq \alpha \leqq 500\ \text{Å}$, $1\ \mu\text{m} \leqq \beta \leqq 3\ \mu\text{m}$; and forming a single photoconductive layer consisting of amorphous silicon only and directly on the surface of said porous layer.

2. A method of fabricating an electro-photographic photosensor in which amorphous silicon as a photoconductive layer is formed on a surface of an aluminum base comprising the steps of:

forming an alumite layer which comprises a barrier layer having a thickness $\alpha$ and a porous layer having a thickness $\beta$ on the surface of said aluminum base by an alumite process such that the thicknesses $\alpha$ and $\beta$ fall within the respective ranges of:

$10\ \text{Å} \leqq \alpha \leqq 200\ \text{Å}$ $1\ \mu\text{m} \leqq \beta \leqq 5\ \mu\text{m}$; and forming a single photoconductive layer consisting of amorphous silicon only and directly on the surface of said porous layer.

* * * * *